US005393334A

United States Patent [19]

Hutcheson

[11] Patent Number: 5,393,334

[45] Date of Patent: Feb. 28, 1995

[54] PAPERMAKING COMPOSITIONS, PROCESS USING SAME, AND PAPER PRODUCED THEREFROM

[75] Inventor: Gary S. Hutcheson, Macon, Ga.

[73] Assignee: Sequa Chemicals, Inc., Chester, S.C.

[21] Appl. No.: 213,264

[22] Filed: Mar. 15, 1994

Related U.S. Application Data

[63] Continuation-in-part of Ser. No. 748,098, Aug. 21, 1991, Pat. No. 5,296,024.

[51] Int. Cl.[6] ..... C09D 7/12; C09D 101/02; C09D 5/00; D21H 17/14

[52] U.S. Cl. ..... 106/199; 106/203; 106/243; 252/8.8; 162/152; 162/158

[58] Field of Search ..... 106/179, 199, 203, 243; 252/8.8; 162/152, 58

[56] References Cited

U.S. PATENT DOCUMENTS

| | | | |
|---|---|---|---|
| 2,142,986 | 1/1939 | Arnold, Jr. | 162/172 |
| 2,772,967 | 12/1956 | Padbury et al. | 162/179 |
| 2,932,602 | 4/1960 | Holgersson et al. | 162/158 |
| 3,014,836 | 12/1961 | Proctor, Jr. | 162/181.8 |
| 3,096,232 | 7/1963 | Chapman | 162/172 |
| 3,554,862 | 1/1971 | Hervey et al. | 162/158 |
| 3,554,863 | 1/1971 | Hervey et al. | 162/158 |
| 3,932,210 | 1/1976 | Suzuki et al. | 162/157.7 |
| 4,032,473 | 6/1977 | Berg et al. | 252/358 |
| 4,075,028 | 2/1978 | Amosov et al. | 162/186 |
| 4,225,456 | 9/1980 | Schmidt et al. | 252/321 |
| 4,458,080 | 7/1984 | Boehmke et al. | 162/158 |
| 4,786,367 | 11/1988 | Bogart et al. | 162/158 |
| 4,786,439 | 11/1988 | Pioog et al. | 252/544 |
| 4,806,167 | 2/1989 | Raythatha | 106/465 |
| 4,826,536 | 5/1989 | Raythatha et al. | 106/465 |
| 4,857,126 | 8/1989 | Söremark et al. | 156/205 |
| 4,877,539 | 10/1989 | Pioog | 252/8.8 |
| 4,923,566 | 5/1990 | Shawki et al. | 162/135 |
| 5,062,922 | 11/1991 | Nakajima et al. | 162/158 |
| 5,143,582 | 9/1992 | Arkens et al. | 162/135 |

FOREIGN PATENT DOCUMENTS

| | | | |
|---|---|---|---|
| 2314060 | 11/1973 | Germany | 162/158 |
| 58-87398 | 5/1983 | Japan | 162/158 |

*Primary Examiner*—David Brunsman
*Attorney, Agent, or Firm*—Mitchell D. Bittman

[57] ABSTRACT

A chemical composition for use in the papermaking process to produce a paper having enhanced characteristics of brightness, opaqueness, and sizing is provided. The process using the composition to make the paper and the paper made therefrom are also provided by the present invention. The composition employs a cationic softener base, such as the mono- and di-fatty acid amides of aminoethylethanolamine, to enhance sizing, opacity and brightness. A surfactant, such as an ethoxylated tallow amine and an acid, is used to ensure that the components of the composition remain dispersed therein and that the composition achieves uniform dispersibility on the paper. To speed the production of the composition, a viscosity controlling agent, such as sodium chloride or sodium acetate, may be added thereto. The composition is added to pulp slurry during the papermaking process, and a paper made therefrom exhibits excellent qualities of brightness, opaqueness, water repellency and dispersibility.

28 Claims, No Drawings

PAPERMAKING COMPOSITIONS, PROCESS USING SAME, AND PAPER PRODUCED THEREFROM

This is a continuation in part of Ser. No. 07/748,098 now U.S. Pat. No. 5,296,024, filed Aug. 21, 1991.

Field of the Invention

This invention relates to compositions for use in the papermaking process, a papermaking process employing the compositions to add opaqueness, brightness, and sizing to the paper, and a paper produced using the compositions.

Background of the Invention

The quality of paper produced from cellulose fibers (i.e. wood pulp or the paper produced by the recycling of paper made from wood pulp) is often judged by its brightness, opacity, and sizing (or water repellency). Paper producers have long sought to improve these vital characteristics so that an enhanced paper may be obtained.

These three desired characteristics have been obtained in the past by supplying the pulp slurry of cellulose fibers or furnish with additives prior to the slurry entering the papermaking machine. Various additives are well known in the art. For example, titanium dioxide powder is known to be an excellent whitener. Titanium dioxide, however, is among the most expensive materials that may be added to the slurry. Thus, despite the effectiveness of such material as a brightener, its use is limited and satisfactory replacements have been needed.

Kaolin clay has also been used as a filler in paper to improve brightness in the ultimate product. Generally, the kaolin clay is calcined and then suspended in an aqueous solution prior to being added to the furnish. The clay must be continuously agitated prior to entering the slurry or the solid particles begin to form sediment at the bottoms of the clay holding tanks. Although kaolin clay provides brightness, as well as opacity to the finished paper product, the relative difficulty of adding it to the slurry results in a less than excellent additive.

When clay is added to the pulp slurry, the slurry needs additional chemicals. A retention aid is necessary to retain the clay in the sheet, which will add extra cost to the sheet. Adding clay to the slurry will also have an adverse effect on drying the sheet of paper. The paper maker will slow the paper machine down to maximize the drying to make sure the sheet is dried, which will increase the cost of the sheet. The clay also increases wear on the paper machine. This wear shows up in shorter life for some of the parts of the paper machine. The wire, felt, doctor blade and refiners especially, show wear when clay is used. With the increased abrasiveness of the clay down time is longer and more frequent.

Hydrated aluminum silicate has also been employed as a clay substitute in the papermaking process. It has properties similar to kaolin clay and, thus, results in the same disadvantages when used to make paper.

Many compositions have been added to the slurry in an attempt to size the paper, i.e. render the paper water repellent. Most known sizes, such as those disclosed in U.S. Pat. No. 2,142,986 to Arnold, Jr. and U.S. Pat. No. 3,096,232 to Chapman, employ a type of wax. For example, Arnold, Jr. discloses that an emulsion of wax in a solution of deacetylated chitin, paraffin waxes, Japan wax, carnauba wax, higher aliphatic alcohols, or synthetic waxes may be employed as the waterproofing agent in a sizing composition. A softening agent such as aliphatic alcohols containing 12 to 20 carbons is also present in the composition of Arnold, Jr. Chapman discloses the use of paraffin waxes or water-insoluble derivatives of resins for producing aqueous wax emulsions with cationic modified starches.

U.S. Pat. No. 2,772,967 to Padbury shows a paper sized by adding thereto a salt of a high molecular weight composition prepared by reacting a dialkanolamine or trialkanolamine with a long chain fatty acid. The salt is diluted with water to form a dispersion containing a 5% concentration of sizing agent before being applied to the cellulosic fibers. Apparently, such a dilution of strength was necessary heretofore because until the present invention, preparation of the stearamides which would allow the composition to remain pourable at concentrations greater than 5% was unknown. Without the ability to remain in an emulsion and, hence, be poured, concentrations of stearamides approaching those disclosed herein have not been possible for use on pulp fibers. An important feature also disclosed by the patent is that the salts are cationic and are, therefore, absorbed by the anionic cellulosic fibers.

Numerous sizing agents are known. Generally, the known sizes are cationic materials. Although the sizes' cationic nature increases their absorption by the fibers to which they are applied, their cationic nature generally prevents them from being used to the full extent possible in connection with a brightener and opacifying agent. It is well known in the art that although cationic materials often increase sizing, they reduce the brightness of the material to which they are applied. The use of cationic sizes in the paper industry reduces the quality of the paper made therefrom. Because the addition of cationic sizing agents to paper generally reduces the brightness thereof, cationic sizes have not been heretofore preferred as a size for paper, and in particular, as a size for paper made from recycled pulp which often lacks the inherent brightness of paper made from virgin pulp.

Although the prior art shows agents for sizing paper and agents for increasing the brightness and opaqueness of paper, the particular features of the present invention are absent from prior art. The prior art is generally deficient in affording a composition for use in a papermaking process that has the ability to provide sizing to paper without reducing brightness or opacity. Furthermore, the prior art brighteners and opacifying agents fail to allow good runnability of papermaking machines due to their abrasive characteristics. The present invention, however, overcomes the shortcomings of the prior art in that a composition is disclosed herein for simultaneously increasing the brightness, opacity, and sizing of paper made from a pulp slurry of cellulose fibers containing the composition.

Summary of the Invention

It is an object of the present invention to provide a composition for adding to paper during the papermaking process so that the resulting paper has enhanced characteristics.

It is another object of the present invention to provide a composition that adds brightness, opacity and sizing to paper to which it is added.

Still another object of the present invention is to provide a composition for adding to the pulp slurry of cellulose fibers from which paper is formed wherein brightness and opacity of the paper is not sacrificed in favor of sizing.

Another object of the present invention is to provide a composition for brightening, opacifying and sizing a paper which achieves substantially uniform dispersibility on said paper.

Still another object of the present invention is to provide a method for adding a composition to the papermaking process to result in a paper having desirable physical characteristics.

Still another object of the present invention is to provide a process wherein a composition is added to recycled pulp of cellulose fibers to form a paper having desirable physical characteristics.

Still another object of the present invention is to provide a process for adding a composition to pulp slurry of cellulose fibers in the papermaking process that will result in a paper having enhanced brightness, opacity, and sizing.

Yet another object of the present invention is to provide a paper having the desirable characteristics of brightness, opacity, and sizing.

Still another object of the present invention is to provide a paper to which a composition has been added during the papermaking process to give the paper enhanced sizing, brightness, and opacity.

Generally speaking, the present invention is directed to a composition used as an additive to the pulp slurry of cellulose fibers from which paper is formed, the process of making paper from the additive-containing slurry, and the paper made according to that process. The composition is an emulsion of cationic softener base in water. A dispersion aiding component, or surfactant, reduces the surface tension of the composition such that adequate emulsification of the composition's components may occur. The surfactant also ensures that the composition achieves substantially uniform dispersion within the slurry to which it is added and, therefore, uniform dispersion on the final paper product. A viscosity controlling agent may be added to the composition as necessary or desired.

The composition is added to the pulp slurry after the wood pulp has been bleached to remove lignin and other undesirables and de-inked, if recycled paper pulp is being used, but before the pulp enters into the headbox of a papermaking machine. The composition may be added alone, or in conjunction with other brighteners, opacifying agents, and sizes. For example, in one embodiment of the invention, the composition hereof may be added in conjunction with papermaking clays such as kaolin.

The composition may be added to any pulp slurry to obtain the desired physical characteristics and is especially useful for enhancing the characteristics of paper made from the recycled pulp of cellulose fibers. The amount of composition, as well as the amounts of each component in the composition, will vary depending on the characteristics and types of pulp slurry to which the composition is added. As is well known, different sources of wood pulp have different peculiarities that attribute to their ability to be brightened, made more opaque and more water resistant, and easily processed. For instance, some wood pulp requires a higher concentration of brightening and opacifying agents than others to produce a finished paper product having identical characteristics.

The cationic softener base employed in the present invention includes the mono- and distearamides of aminoethylethanolamine and mixtures thereof. The stearamides are sufficient in themselves to provide the desired characteristics when paper is made therefrom, however, as explained below, other components may be added to the composition to increase the desired characteristics.

In making the composition, a long chain fatty acid having between 12 and 18 carbons such as stearic acid is reacted with an alkanoldiamine to form the mono- and di-substituted fatty acid amides of alkanoldiamines. The formation of the amides takes place at a high temperature, preferably about 392° F. (200° C.). The cationic softener base is then allowed to cool to about 200° F. (93° C.). The other components of the composition, such as the surfactant, viscosity controlling agent, if desired, and the water, are preheated to about 190° F. (88° C.). The cationic softener base is then added to these preheated components and the composition is vigorously agitated for about one hour so that the fatty acid amides are substantially dispersed within the emulsion. Furthermore, a viscosity controlling agent may be added to the composition as necessary or desired. The composition is then added to pulp slurry and paper having the desired characteristics of brightness, opacity, and water repellency is produced therefrom. The homogenizing/agitation process insures that the fatty acid amides are reduced to a small particle size so that substantial uniformity of dispersion within the pulp slurry is achieved.

The composition of the present invention may employ an amphoteric softener as an additional brightening agent in addition to the cationic softener base. In this embodiment the composition contains an acid such as acetic acid to completely dissolve the cationic softener and maintain the pH of the composition between about 4 and about 5, a surfactant to ensure adequate dispersion, a carbamide, and water.

The paper obtained from the papermaking process employing a slurry containing the present inventive composition exhibits excellent brightness, opacity, and sizing characteristics. Unlike prior art papermaking additives that employ cationic components, brightness and opacity of paper made with the claimed composition are not sacrificed in favor of sizing.

Description of Preferred Embodiments

A composition for use in the papermaking process such that opaqueness, brightness, and sizing is added to the paper, a papermaking process employing same, and a paper produced from same are provided. Generically, this composition comprises a cationic softener base, a dispersion-aiding component, or surfactant, and water. Another embodiment of this composition comprises a cationic softener base, an acid for controlling pH, a surfactant, and water. Additionally, a viscosity controlling agent may be employed as necessary or desired to aid in production of any of the particular embodiments of the composition.

The composition is added to a pulp slurry of cellulose fibers (i.e. wood pulp or recycled paper made from wood pulp) after the pulp has been bleached but before the pulp enters into the headbox of a papermaking machine. The composition may be added alone, or in conjunction with other brighteners, opacifying agents, sizes and additives employed in the papermaking process.

The type of pulp slurry to which the composition may be added is unimportant. In fact, the make-up of the composition may be varied depending on the type of cellulose fibers from which the pulp slurry is made. For instance, if the pulp is inherently dark and requires more brightening, the amount of amphoteric softener or saccharide in the composition may be increased to add brightness to the paper. On the other hand, if the paper produced from the pulp lacks a sufficient degree of water repellency, the amount of cationic softener base may be increased to improve sizing. To increase opaqueness, additional amounts of the cationic softener base may be employed. In addition, the use of pulp which has been recycled from papers may require other adjustments to the composition, particularly when the recycled pulp is dark or otherwise discolored. All such adjustments to the composition may be easily made by one of ordinary skill in the art according to the invention disclosed herein.

The pulp to which the composition is added is made into a slurry using conventional techniques. After formation, the slurry is stored in holding tanks or fed to a papermaking machine, such as a Fourdrinier machine, in a conventional manner. The pulp may be bleached to remove unwanted pollutants such as lignins and deinked if pulp made from recycled paper is used. The papermaking composition disclosed herein may be added either to the slurry when it is in the holding tank or may be added to the slurry as it moves along to the headbox of the papermaking machine. Preferably, the composition is applied to the pulp in the holding tank before it travels to the headbox.

When the slurry containing the composition reaches the headbox of the papermaking machine, paper is formed therefrom using conventional papermaking techniques and materials. The paper produced according to the present invention exhibits excellent characteristics of opaqueness, brightness, and water resistance.

In a further embodiment of the present invention, other materials may be added in conjunction with the composition. For instance, kaolin clay may be added in addition to the inventive composition so that the paper made therefrom exhibits increased opaqueness. Other additives which are well known in the art may also be added in conjunction with the composition disclosed herein.

The inventive composition disclosed herein generally comprises a cationic softener base as brightener, opacifier and size, a surfactant, and may include the viscosity controlling agent described below. Although the preferred cationic softener bases employed in the present invention include the mono- and distearamides of aminoethanolamines and mixtures thereof, any of the fatty acid amides may be used and the cationic softener is not limited to the stearic acid amides. Aminoethanolamines available include aminoethylethanolamine, aminobutylethanolamine, aminomethylethanolamine, and the other alkyl-substituted aminoethanolamines. The preferred stearamide derivatives are aminoethylethanolamine monostearylamide and aminoethylethanolamine distearylamide which are mono- and disubstituted fatty acid amides of alkanoldiamines. Other cationic softener bases such as derivatives of imidazole, and in particular imidazoline, may also be used in the present composition.

The preferred cationic softener bases have the general formula

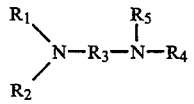

wherein $R_1$ represents a

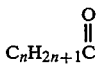

group whereas n is a number from 11 to 17, wherein $R_2$ and $R_5$ represents a

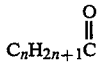

group wherein n is a number from 11 to 17 or a hydrogen, wherein $R_3$ represents an alkyl group, and wherein $R_4$ represents an aliphatic alcohol. Compounds according to this general formula are the reaction products formed from fatty acids and diamines, and, more specifically, are the reaction products of fatty acids and alkanoldiamines (diamine aliphatic alcohols). The chosen fatty acid and chosen alkanoldiamine are mixed and heated at temperatures of 160°–200° C. to produce the monoalkylamides, dialkylamides, and mixtures thereof. The most preferred cationic softener bases have the formulas $$C_{17}H_{35}CONHCH_2CH_2NHCH_2CH_2OH$$

and $$(C_{17}H_{35}CO)_2NCH_2CH_2NHCH_2CH_2OH$$

which represent the mono- and distearamides of aminoethylethanolamine.

The fatty acid amides can also be prepared from fatty acids which include the hydroxy substituted organic acids and/or the unsaturated carboxylic acids (i.e. having one or more unsaturated carbons), preferably having a carbon chain length of $C_{12}$ to $C_{18}$. Suitable fatty acids included within this group are ricinoleic acid, oleic acid, linoleic acid, linolenic acid and eleostearic acid. Surprisingly it has been found that the fatty acid amides formed from the hydroxy substituted fatty acids and/or unsaturated fatty acids in addition to imparting opaqueness, brightness and sizing to the paper, also exhibit increased strength as compared to saturated and unsubstituted fatty acids. The hydroxy substituted and/or unsaturated fatty acids may be reacted alone with the diamines, preferably the alkanol diamines, or in combination with a saturated non-substituted fatty acid (preferably stearic acid). The cationic softener base prepared utilizing the hydroxy substituted and/or unsaturated fatty acids are also represented by the above general formula, but wherein $R_1$, $R_2$ and $R_5$ are represented by either a $$C_nH_{2n-2}(OH)\overset{O}{\overset{\|}{C}},\quad C_nH_{2n-1}\overset{O}{\overset{\|}{C}},\quad C_nH_{2n-3}\overset{O}{\overset{\|}{C}},$$

-continued $$C_nH_{2n-5}\overset{\overset{\displaystyle O}{\|}}{C} \text{ or } C_nH_{2n+1}\overset{\overset{\displaystyle O}{\|}}{C}$$

group wherein n is a number from 11 to 17 and wherein $R_2$ and $R_5$ can in addition be a hydrogen.

In an embodiment of this invention the reaction product is formed by reacting 5 to 85% (preferably 20 to 85%) by weight of a hydroxy substituted organic acid, 0 to 80% (preferably 0 to 60%) by weight of stearic acid and 10 to 30% (preferably 15 to 20%) by weight of an alkanol diamine. The preferred hydroxy substituted organic acid is ricinoleic acid.

Preferably, the cationic softener base used in the present composition will predominantly consist of di-substituted fatty acid amides, particularly distearamides. Because the di-substituted amides have two fatty acid amide groups as opposed to the mono-substituted amides which have only one fatty acid amide group, the di-substituted amides are more active cationic bases. Particularly, the distearamides show a stronger affinity for the cellulosic fibers to which they are absorbed.

In addition, it is preferred that the particle size of the cationic softener base be as small as possible. The cationic softener base made according to Example 1 herein is a hard solid substance. In order for the cationic softener to remain in an emulsified state as in the composition described herein, intense agitation and heating is required. Moreover, it is highly desirable that the papers produced according to the present invention have substantially uniform brightness, opaqueness, and sizing over its entire surface. Smaller particle sizes aid in the dispersibility of the particles within the slurry so that the desired characteristics are uniform throughout the paper. These smaller particle sizes may be obtained by either homogenizing the product in a high speed mixer or by rapidly cooling the composition from the high temperature at which the cationic softener base is formed as described herein.

A preferred surfactant used in the present is an ethoxylated surfactant such as POE (15) tallow amine. The surfactant further contributes to the desired dispersability of the fatty acid amides in the water emulsion. If the amount of surfactant added is excessive, the sizing capability of the composition will be adversely affected. In the absence of a surfactant, the paper may be of a poor quality due to the decreased dispersibility of the composition, which results in spots or specks on the paper indicating a lack of dispersibility.

A weak acid is preferred to disperse the solid cationic softener base. The acid maintains an acidic pH preferably within the range of from about 4 to about 5 during the making of the composition. The acid acts as a catalyst by creating an acidic environment wherein the cationic softener base exhibits increased reactivity. Weak organic acids such as acetic acid or formic acid are especially preferred in the composition. Strong acids, of course, may be used to control the pH, but cost and safety considerations may restrict their use.

Preferably, a viscosity controlling agent such as a salt is added during production of the papermaking composition. Generally, the sodium salts and chloride salts are known viscosity controlling agents. Preferred salts include sodium acetate and sodium chloride. This component may be deleted, but the processing time for creating the composition will be substantially increased.

The present invention may be better understood by reference to the following examples.

EXAMPLE 1

Mono- and distearamides of aminoethylethanolamine are made by reacting stearic acid with aminoethylethanolamine. 1845 grams of stearic acid (65% stearic acid and 35% palmitic acid) and 405 grams of aminoethylethanolamine are charged to a reactor and sparged with nitrogen at a rate of 10 $ft^3$/min. Using slow agitation, the temperature of the reactor is raised to between about 385° and about 400° F. (196°-204° C.) and preferably about 392° F. (200° C.), and held at such a temperature for about 45 minutes. The product is then allowed to cool at room temperature. The liquid weight percentages of the components used in making the stearamides are 82.83% stearic acid and 17.17% aminoethylethanolamine.

EXAMPLE 2

Specifically, a composition of the present invention comprises a cationic softener base, particularly the mono- and distearamides of aminoethylethanolamine made according to Example 1 above, sodium acetate or sodium chloride as a viscosity controlling agent, and a polyoxyethylated surfactant such as the tallow amine previously described. As discussed above, the viscosity controlling agent may be eliminated but processing time will be increased.

A composition of this invention is made by charging 110 grams of the mono- and distearamides and mixtures thereof made according to Example 1 to a mixing chamber equipped with an agitator. The temperature is raised to about 212° F. (100° C.) and agitation is begun until a melt is formed. An emulsion is made by adding water to the mixture and allowing the mixture to cool to between about 180° and about 190° F. (82°-88° C.). Two grams of sodium acetate are then added to thin the mixture. When the temperature drops below about 165° F. (74° C.), and preferably at about 160° F. (71° C.), 2 grams of POE (15) tallow amine (TAM 15 obtained from Henkel Co.) are added to the mixture. The addition of the surfactant aids in keeping the composition in an emulsion. Agitation continues for about 30 minutes while water is metered into the mixing tank to bring the total amount of the water employed in making the composition to about 886 grams. The weight percentages of the components used in the present example are set forth below:

| Component | Dry Weight Percent of Component |
|---|---|
| Cationic Softener Base (mono- and distearamides of aminoethylethanolamine made in Example 1) | 11.00% |
| Viscosity controlling Agent (sodium acetate) | 0.20% |
| Surfactant (POE (15) tallow amine) | 0.20% |
| Water | 88.60% |

EXAMPLE 3

A composition of Example 2 was added to a pulp slurry prior to entering a papermaking machine headbox at a rate of about 4 gallons per minute and a paper was formed therefrom. Further testing established that a rate of 0.5 to 5 gallons per minute, and more specifically, about 1.0 to 2½ gallons per minute is preferred for adding the composition of Example 2 to the slurry to create a paper having the desired characteristics.

As explained above, the making of stearamides according to Example 1 produces a hard, solid compound. If the preferred dispersibility of the composition is to be obtained, the cationic softener base requires homogenization prior to combining with the other components of the composition. One method of homogenization employs vigorous agitation and heating. Instead of allowing the mono- and distearamides of aminoethylethanolamine to cool to room temperature as described in Example 1, the stearamides are only allowed to cool to about 200° F. (93° C.). The cationic softener is held at this temperature, which is just below the boiling point of the liquid, until it is combined with the other components. The other components of the composition are preheated to about 190° F. (88° C.) and the required amount of cationic softener base is added thereto to comprise the appropriate percentage within the composition. The composition is then held at about 200° F. and vigorously agitated for about one hour. This results in an emulsion having substantially uniform small particle size so that good dispersion of the composition with respect to the pulp slurry is achieved thereby.

Alternatively, the composition may be homogenized to provide the good dispersion characteristics by rapid super cooling of the composition. Using this method, the stearamides are held at a temperature of about 200° F. and then transferred in the appropriate amount to the preheated remaining component mixture. After achieving a temperature of about 200° F., the mixture is rapidly cooled to room temperature by subjecting the mixture to dry ice or other super cooling methods. This results in an emulsion having substantially uniform small particle size throughout. Such super cooling methods may include the use of storage tanks being cooled by circulating freon, but the method of making the present composition is not limited to a particular method of super cooling.

The super cooling of the composition may be employed in addition to the homogenization by agitation described above, or may be used in lieu of such agitation. Examples of creating the preferred homogenous composition follow.

EXAMPLE 4

Mono- and distearamides of aminoethylethanolamine are made generally according to Example 1 above but instead of allowing the product to cool to room temperature, the stearamides are only allowed to cool to about 200° F. (93° C.). The components of the composition in the amounts and percentages described in Example 2 (2 grams of POE (15) tallow amine, 2 grams of sodium acetate, and 886 grams of water) are preheated to about 190° F. (88° C.) in a Shear Hill Mixer manufactured by Hill Manufacturing Company. An amount of the mono- and distearamides of aminoethylethanolamine sufficient to comprise about 11% by dry weight of the final composition (110 grams) is added to the mixer. High-speed agitation is begun and continued at 200° F. for about one hour. The resulting composition achieves the preferred dispersibility with respect to the pulp slurry when added thereto as described in Example 3.

EXAMPLE 5

A composition of the present invention may alternatively be made by employing super-cooling to achieve the desired dispersibility of the composition with respect to the slurry. The mono- and distearamides of aminoethylethanolamine are made generally according to the process of Example 1. Instead of allowing the mixture to cool to room temperature, however, the emulsion is allowed to cool only to about 200° F. (93° C.). The remaining components of the composition, whether they be the surfactant, viscosity controlling agent and water as described in Example 2, the viscosity controlling agent, surfactant, amphoteric softener, water, carbamide, and acid as described in Examples 6 and 7, or sucroseoxyacetate, water, and viscosity controlling agent as described in Example 13 are preheated to about 190° F. The stearamides and other components are then mixed and agitated at about 200° F. for about 10 minutes. After such mixing, the mixing vessel is rapidly cooled using a dry ice pack so that the temperature of the emulsion is reduced to room temperature or below in about 10 minutes or less. This cooling process also results in a composition having the desired dispersion characteristics.

In Examples 6 and 7 wherein an amphoteric softener is employed, the amphoteric softener, viscosity controlling agent, acid, surfactant, carbamide, and water are preheated in the Shear Hill Mixer. The cationic softener base in the required amount is then maintained at a temperature of about 200° F. after creation thereof and is metered into the mixer. Agitation continues at about 200° F. for about one hour to achieve a preferred composition having the desirable characteristics of brightness, opacity, water repellency, and uniform dispersibility throughout the slurry. Likewise, in the embodiments employing a sucroseoxyacetate as described in Example 13, the sucroseoxyacetate, water, and viscosity controlling agent are preheated in the Shear Hill Mixer and the cationic softener base is metered therein at a temperature of about 200° F. Vigorous agitation is maintained at about 200° F. for about one hour to achieve the preferred composition. This mixing process reduces the size of the particles held in the emulsion so that the composition is substantially homogeneous throughout.

As mentioned above, the rapid super-cooling of the mixture may be employed in addition to the one-hour agitation in the mixer as described in Example 4 or may, alternatively, be employed in lieu of such agitation. Preferably, however, the prolonged high-speed agitation of Example 4 will be combined with the rapid super cooling described in Example 5 to achieve the preferred product. It will also be appreciated by those of ordinary skill in the art that other methods and apparatus may be employed to achieve such super cooling. It will also be understood by those of ordinary skill in the art that the super agitation and/or super cooling described in Examples 4 and 5 may be used in producing any of the various embodiments of the present invention to achieve good dispersibility of the composition with respect to the paper made from the slurry.

By employing the processes described in Examples 12 and 13, a method of preparing an emulsion of fatty acid amides of an alkanoldiamine in water where the concentration of fatty acid amides is greater than 5% is provided. As explained earlier, prior art methods of preparing emulsions of fatty acid amides employed in the present composition in water have been limited to concentrations of 5% or less. By providing the fatty acid amides of the alkanoldiamine at a temperature of about 200° F., mixing the fatty acid amides with the liquid serving as an emulsifier until the fatty acid amides are dispersed therein and then rapidly cooling the mixture of fatty acid amides and emulsifier such that the fatty acid amides remain in an emulsified state with respect to the emulsifier results in the ability to provide an emulsion where the fatty acid amides' concentration is greater than 5%. Of course, such rapid cooling processes described in Example 13 may be combined with the super agitation process of Example 12 to provide for even greater percentages of fatty acid amides and emulsion.

EXAMPLE 6

Another embodiment of the papermaking composition of the present invention is prepared as follows. 1075 grams of sodium stearoamphoglycinate, 3400 grams of the mono- and distearamides of aminoethylethanolamine made according to Example 1, 325 grams of POE (15) tallow amine and 9996 grams of water are charged to a mixing tank equipped with an agitator. Heating and agitation are begun, and the mixture is heated to between about 195 and about 205° F. (91°–96° C.) and held at this temperature for approximately one hour. When all the solid components in the mixing tank are melted and homogeneously dispersed, 499 grams of acetic acid is added and agitation is continued for about 15 to 30 minutes. After such agitation, about 100 grams of sodium chloride is added and agitation continued for another 30 minutes. Thereafter, heating is discontinued, cooling water is cycled through the jacket coils surrounding the mixing tank, and 8330 grams of additional water is added to the mixing tank to cool the contents. The temperature of the dispersion is monitored until it reaches 140° F. (60° C.). 6000 grams of urea is then added to the mixing tank with cooling and agitation continuing until the temperature of the constituents reaches about 110°–115° F. (42°–46° C.) and all the carbamide dissolved.

The dry weight percentages of the components are shown below:

| Component | Dry Weight Percent of Component |
|---|---|
| Anhateric Softener (sodium stearoamphoglycinate) | 3.60% |
| Cationic Softener Base (mono- and distearamides of aminoethylethanolamine made in Example 1) | 11.50% |
| Viscosity Controlling Agent (sodium chloride) | 0.34% |
| Acid (acetic acid) | 1.70% |
| Surfactant (POE (26) tallow amine) | 1.10% |
| Carbamide | 20.30% |
| Water | 61.50% |

EXAMPLE 7

The process and components described in Example 6 were employed in making a further embodiment of the inventive composition. In this composition, dry weight percentages used were as follows: amphoteric softener (sodium stearoamphoglycinate) about 1.13%, the cationic softener base (mono- and distearamides of aminoethylethanolamine) about 8.00%, viscosity controlling agent (sodium chloride) about 0.25%, acid (acetic acid) about 0.98%, surfactant (POE (15) tallow amine) about 0.75% weight, carbamide (urea) about 14.00%, and water composed the remaining about 74.89% by weight.

It has also been found through further refining of the composition that the amphoteric softener, preferably sodium stearoamphoglycinate, should be in a range of between about 0.5% to about 4%. The cationic softener base, preferably the mono- and distearamides of aminoethylethanolamine made according to Example 1, should be present in an amount of about 7.5% to about 13%. The viscosity controlling agent should be present in an amount of about 0.25 to about 0.35%. The acid, preferably acetic or formic acid, should be present in an amount at least of about 0.9% so that the pH of the mixture is controlled between about 4 and about 5. The non-ionic surfactant, preferably POE (15) tallow amine, should be present in an amount of at least about 0.20%. The carbamide used in the composition should be within the range of from about 10% to about 25% and the water should be in a range of from about 60% to about 75%.

EXAMPLE 8

The composition made according to Example 6 was added to a pulp slurry as the pulp slurry was transported along a feeding mechanism to the headbox of a Fourdrinier machine. The composition was added at a rate of 3 to 3½ gallons per minute, and paper produced therefrom exhibited the desired characteristics. The coefficient of friction of the slurry after adding the composition was measured and determined to be 0.3.

EXAMPLE 9

The composition made according to the process described above in Example 6 was added to a pulp slurry as the pulp slurry was transported along a feeding mechanism to the headbox of a Fourdrinier machine. The composition was added at a rate of 2.8 gallons per minute, and paper produced therefrom exhibited the preferred characteristics.

EXAMPLE 10

The composition made according to Example 6 was added to a pulp slurry as it was transported to the headbox at a rate of 5 gallons per minute. The paper produced according to this example showed increased opacity and sizing but a similar brightness compared to the paper produced according to Example 8.

EXAMPLE 11

The composition made according to the process of Example 6 was added to a pulp slurry at a rate of 2 gallons per minute. In addition, a 33% aqueous solution of kaolin clay was added coincidentally with the papermaking additive to the slurry at a rate of 8 gallons per minute and paper was produced therefrom. Although the paper exhibited the desired characteristics, the coefficient of friction of the slurry after adding the composition and the clay was determined to be 0.7.

A 33% aqueous slurry of kaolin clay alone was added to a pulp slurry as it traveled to a Fourdrinier machine so that paper produced therefrom could be compared to paper made with the present invention. To produce paper having brightness characteristics comparable to those exhibited by the paper made according to Example 8, kaolin clay was added to the slurry at a rate of about 12 gallons per minute.

When adding the composition to a pulp slurry as described in Example 8, without the addition of kaolin clay, the Fourdrinier machine exhibited excellent runability, less drag, less power requirements, and overall smoother operation than the machine did when kaolin clay was added to the slurry. These characteristics add to the overall operational printability of the paper made using the present composition.

The coefficient of friction for the pulp slurry without the addition of any kaolin clay or the addition of the inventive composition was also measured. The coefficient for the slurry without any such additives was 0.5. As evidenced by the low coefficient of friction noted in Example 8, addition of the inventive composition to a pulp slurry actually decrease the amount of drag as compared to a papermaking process using a pulp slurry in which no additives are employed.

EXAMPLE 12

Sucroseoxyacetate for use as a component in compositions according to the present invention was made as follows. 600 grams of 84% acetic acid was added to 400 grams of sucrose in a vessel equipped with an agitator as in the preceding examples. The mixture was agitated and heated to about 135°-140° F. (57°-60° C.). Temperature was then held until titrations indicated one gram of reaction mixture dissolved in 100 mls. of water (6.0 to 7.0 mls. of 1.0M sodium hydroxide to titrate to phenolphthalein endpoint). The resulting sucroseoxyacetate was then allowed to cool for further use.

EXAMPLE 13

An embodiment of the present invention employing a saccharide as a brightener and size is made as follows. 110 grams of the mono- and distearamides and mixtures thereof made according to Example 1 are heated to about 212° F. (100° C.) until a melt thereof is formed. An emulsion is created by adding water to the melt followed by agitation. Two grams of sodium acetate is added to the mixing tank after the emulsion thins and cools to about 180°-190° F. (82°-88° C.). Cooling and agitation are continued until the temperature of the emulsion drops below about 165° F. (74° C.), whereupon 50 grams of the sucroseoxyacetate made according to Example 12 is added to the mixing tank. Agitation continues for about 30 minutes and additional water is metered into the mixing tank so that the total amount of the water added totals about 838 grams.

The weight percentages of the components used in the present example are set forth below:

| Component | Dry Weight Percent of Component |
|---|---|
| Cationic Softener Base (mono- and distearamides of aminoethylethanolamine made in Example 1) | 11.00% |
| Sucroseoxyacetate (made in Example 12) | 5.00% |
| Viscosity Controlling Agent (sodium acetate) | 0.20% |
| Water | 83.80% |

EXAMPLE 14

A composition of Example 13 was added to a pulp slurry prior to entering a papermaking machine headbox at a rate of 3-3.5 gallons per minute and a paper having the desired characteristics was formed therefrom.

EXAMPLE 15

A composition made according to the process of Example 13 was added to a pulp slurry at a rate of about 2½ gallons per minute in addition to a 33% aqueous solution of kaolin clay which was added at a rate of 8 gallons per minute. The paper produced therefrom exhibited the desired characteristics but the slurry had a coefficient of friction of 0.7.

The opacity, brightness and water repellency of the paper produced from the slurry made in Examples 3, 8 and 14 were measured, averaged, and compared to the paper made from a slurry from pulp of a similar source to which no brightening, opaquing, or sizing agents had been added. The results are shown below:

| | Opacity* | Brightness* | Size** |
|---|---|---|---|
| Plain Paper | 90.5-91.0 | 58-59 | instant |
| Paper of Example 3 | 94.5-95.5 | 58-60 | 47 sec. |
| Paper of Example 8 | 94.0-94.5 | 58-59 | 50 sec. |
| Paper of Example 14 | 94.0-94.5 | 60-61 | 90 sec. |

*Opacity and brightness were measured using a Technidyne Technibrite Micro TB-1C. Measurements are given in TAPPI standard units.
**Sizing was measured using the standard water drop test.

One with skill in the art will appreciate the fact that the rate of adding any of the embodiments of the inventive composition to a pulp slurry will vary depending on the peculiarities of the pulp, the characteristics desired in the paper made therefrom, and the capabilities of the papermaking machine and slurry feeding mechanism. As previously explained, these factors will also influence the exact amounts of each component used in producing the papermaking composition. Testing, however, showed that the preferred rate of adding the composition to achieve optimal characteristics and a low coefficient of friction was between 2 and 5 gallons per minute.

Although preferred embodiments of the invention have been described using specific terms, devices, concentrations, and methods, such description is for illustrative purposes only, and it is to be understood that changes and variations may be made without departing from the spirit or the scope of the following claims.

Example 16

To a resin flask equipped with an agitator and a nitrogen sparge, 423 gms of ricinoleic acid is charged. The solid material is heated until a molten state is reached at 110° C. The amino ethyl ethanol amine (AEEA) is added slowly maintaining the temperature below 130° C. After the amino ethyl ethanol amine (AEEA) charge is complete the batch is heated to 200° C. Water of reaction starts to distill at 150° C. At 200° C. the acid value is checked and it is 4.5. Cooling is put on and at 80° C. the viscous liquid is poured into a suitable container till it becomes a solid. The final product is a light tan solid (Sample #1).

A second sample was prepared using the procedure discussed above. The amount of reactants were changed to 197 grams of ricinoleic acid, 221 grams of stearic acid and 82 grams of AEEA.

The two samples were emulsified using the following procedure. To 33 grams of the above base is added 263 grams of water which contains 0.8 grams of Coconut amine with 2 moles of ethoxylate, 6 grams of 84% acetic acid and 0.25 grams of sodium acetate. The mixture is heated to 93° C. and held with agitation at that temperature for 30 minutes to stabilize the emulsion. The emulsion is cooled down and the solids are adjusted to 11% and the pH is measured at 4.3.

Hand sheets 8×8 inches weighing 2 grams were prepared with the samples by adding 0.24 grams of the samples to a furnish containing the wood pulp. The sheets after pressing at 40 psig to squeeze out water are dried at 240° F., then conditioned (TAPPI standard T402 OM-88), then calendared at 150° F. and 600 psi.

The hand sheets were tested as follows: brightness and opacity were measured on a Technobrite instrument with an average of five readings being taken; the Mullen-Burst test measuring strength were run according to TAPPI standard T403 OM-85; the Scott Bond internal bond strength was measured on a Scott Bond tester; the tensile strength was measured on Instron Model 1011 using TAPPI test procedure T404 OM-87; and the tear resistance was measured on an Elmendorf tester according to TAPPI procedure T414 OM-88. The hand sheets had the following properties:

| | Pulp | #1 | #2 |
|---|---|---|---|
| | 20# of sample/ton of pulp | | |
| Brightness | 58.2 | 57.7 | 57.8 |
| Opacity (TAPPI) | 92.4 | 93.6 | 93.9 |
| Opacity (ISO) | 87.1 | 88.9 | 89.4 |
| Mullen-Burst | 7.4 | 7.6 | 6.6 |
| Scott Bond | 63.0 | 55.5 | 54 |
| Tear | 34.4 | 37.1 | 32.5 |
| | 40# of sample/ton of pulp | | |
| Brightness | 58.2 | 57.3 | 57 |
| Opacity (TAPPI) | 92.4 | 94.9 | 95.6 |
| Opacity (ISO) | 87.1 | 90.9 | 92 |
| Mullen-Burst | 7.4 | 7.9 | 5.6 |
| Tear | 34.4 | 37.1 | 32 |

These results show that the use of the ricinoleic bis amide increases the opacity over the blank paper, with the Mullen-Burst and tear resistance about equal to the blank paper and the Scott Bonds about 10% less than the blank paper. Reacting in stearic acid increases the opacity further, but reduces strength and tear resistance. A product can thus be tailor made to fit the opacity, brightness, strength and tear resistance requirements of the paper mill.

What is claimed is:

1. A composition for adding to a pulp slurry of cellulose fibers during a papermaking process for enhancing brightness, opaqueness and sizing in the paper produced therefrom wherein said composition comprises as a brightening, opacifying and sizing agent a cationic softener base selected from the group consisting of the reaction products formed from the reaction of fatty acids selected from the group consisting of hydroxy substituted fatty acid, unsaturated fatty acid, and mixtures thereof and diamines and wherein said composition further includes a surfactant.

2. The composition as defined in claim 1 wherein said brightening, opacifying and sizing agent is selected from the group consisting of mono-substituted fatty acid amides of alkanoldiamines, di-substituted fatty acid amides of alkanoldiamines, mixtures of mono-substituted fatty acid amides of alkanoldiamines and di-substituted fatty acid amides of alkanoldiamines.

3. The composition as defined in claim 1 wherein the reaction product is formed from the reaction of 5 to 85% by weight of a hydroxy substituted fatty acid, 0 to 80% by weight of stearic acid and 10 to 30% by weight of alkanol diamine.

4. The composition as defined in claim 3 wherein said hydroxy substituted fatty acid is ricinoleic acid and the alkanol diamine is amino ethyl ethanol amine.

5. The composition as defined in claim 1 wherein said fatty acid has a carbon chain length of $C_{12}$ to $C_{18}$.

6. The composition as defined in claim 1 wherein the fatty acids are selected from the group consisting of ricinoleic acid, oleic acid, linoleic acid, linolenic acid, eleostearic acid, and mixtures thereof.

7. The composition as defined in claim 1 wherein said cationic softener base is present in an amount of at least about 7.5% by weight.

8. The composition as defined in claim 1 wherein said cationic softener base is present in an amount of from about 7.5% to about 13% by weight.

9. The composition as defined in claim 1 wherein said surfactant is present in an amount of at least about 0.2% by weight.

10. A composition for adding to a pulp slurry of cellulose fibers for enhancing brightness, opaqueness and sizing of paper made therefrom consisting essentially of a surfactant, a cationic softener base selected from the group consisting of the reaction products formed from the reaction of fatty acids selected from the group consisting of hydroxy substituted fatty acid, unsaturated fatty acid, and mixtures thereof and alkanoldiamines, and water.

11. The composition as defined in claim 10 wherein said fatty acids have a carbon chain length of $C_{12}$ to $C_{18}$.

12. The composition as defined in claim 10 wherein said surfactant is an ethoxylated surfactant.

13. A composition for adding to a pulp slurry of cellulose fibers during the process of making paper for enhancing brightness, opaqueness and sizing in the paper produced therefrom, said composition comprising:

a cationic softener base having the general formula

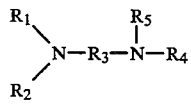

wherein $R_1$, $R_2$, and $R_5$ represents either a $$C_nH_{2n-1}\overset{O}{\overset{\|}{C}},\ C_nH_{2n-5}\overset{O}{\overset{\|}{C}},\ C_nH_{2n-2}(OH)\overset{O}{\overset{\|}{C}},\ \text{or}\ C_nH_{2n-3}\overset{O}{\overset{\|}{C}}$$

group wherein n is a number from 11 to 17 and wherein $R_2$ and $R_5$ can in addition be a hydrogen, wherein $R_3$ represents an alkyl group, and wherein $R_4$ represents an aliphatic alcohol; and a surfactant for achieving adequate dispersion of said composition throughout said paper.

14. The composition as defined in claim 13 further including an agent for controlling viscosity.

15. The composition as defined in claim 14 wherein said viscosity controlling agent is selected from the group consisting of sodium acetate and sodium chloride and said surfactant is an ethoxylated surfactant.

16. The composition as defined in claim 13 wherein said cationic softener base is present in said composition in an amount of at least about 7.5% by weight and said surfactant is present in said composition in an amount of at least about 0.2% by weight.

17. A method of producing an enhanced paper comprising the steps of:

providing a pulp slurry of cellulose fibers;

adding to said slurry a composition wherein said composition comprises a cationic softener base selected from the group consisting of the reaction products formed from the reaction of fatty acids selected from the group consisting of hydroxy substituted fatty acid, unsaturated fatty acid and mixtures thereof and diamines and wherein said composition further includes a surfactant; and forming said slurry into said paper.

18. The method as defined in claim 17 wherein said fatty acids have a carbon chain length of $C_{12}$ to $C_{18}$.

19. The method as defined in claim 17 wherein said composition further comprises a viscosity controlling agent.

20. The method as defined in claim 19 wherein said viscosity controlling agent is selected from the group consisting of sodium acetate and sodium chloride and said surfactant is an ethoxylated surfactant.

21. The method as defined in claim 17 wherein said cationic softener base is present in said composition in an amount of at least 7.5% by weight.

22. The method as defined in claim 21 wherein said surfactant is present in said composition in an amount of at least 0.2% by weight.

23. The method as defined in claim 17 further comprising the step of adding kaolin clay to said slurry.

24. The method as defined in claim 17 wherein said composition is added to said slurry at a rate of from about 1 gallon per minute to about 5 gallons per minute.

25. A paper product made from cellulose fibers, said product having a composition therein comprising a cationic softener base selected from the group consisting of the reaction products formed from the reaction of fatty acids selected from the group consisting of hydroxy substituted fatty acid, unsaturated fatty acid and mixtures thereof and alkanoldiamines and wherein said composition further comprises a surfactant.

26. The paper product as defined in claim 25 wherein said surfactant is an ethoxylated surfactant.

27. The paper product as defined in claim 25 wherein said fatty acids have a carbon chain length of $C_{12}$ to $C_{18}$.

28. The paper product as defined in claim 25 wherein said cationic softener base is present in said composition in an amount of at least 7.5% by weight and said surfactant is present in an amount of at least 0.2% by weight.

* * * * *